United States Patent [19]

Smith

[11] Patent Number: 4,575,873

[45] Date of Patent: Mar. 18, 1986

[54] PANTS CLOSURE

[76] Inventor: James R. Smith, 5535 Blaine, SE., Grand Rapids, Mich. 49508

[21] Appl. No.: 668,152

[22] Filed: Nov. 5, 1984

[51] Int. Cl.[4] ..... A41D 1/06; A41D 1/14

[52] U.S. Cl. ..... 2/234; 2/218; 2/219; 2/235

[58] Field of Search ..... 70/59, 60, 68, 69; 2/234, 235, 96, 218, 219, 220, 1, 251, 252, 338; 292/104, 148; 24/573, 166, 167; 128/132 R, 133, 134, 138 R, 132 D, 138 A; D2/31, 32, 47, 48, 228, 229

[56] References Cited

U.S. PATENT DOCUMENTS

| | | | |
|---|---|---|---|
| 230,308 | 7/1880 | Mayo | 2/251 |
| 353,526 | 11/1886 | Yarger | 24/166 |
| 407,919 | 7/1889 | Blum | 70/59 |
| 613,884 | 11/1898 | Lynch | 70/59 |
| 712,291 | 10/1902 | Gardiner | 24/166 |
| 875,845 | 0/1908 | Perkins | 128/138 R |
| 900,662 | 10/1908 | Brassington | 2/218 |
| 1,040,573 | 10/1912 | Palmer | 292/148 |
| 1,274,610 | 8/1918 | Schueler | 292/148 |
| 1,421,316 | 6/1922 | Slaibelle | 292/148 |
| 1,496,551 | 6/1924 | McCulloch | 292/104 |
| 2,413,141 | 12/1946 | Haggar | 2/252 |
| 2,569,076 | 9/1951 | Schaye | 70/68 |
| 2,591,193 | 4/1952 | Perry | 2/234 |
| 2,675,559 | 4/1924 | Miller | 2/234 |
| 2,688,138 | 9/1954 | Glass | 2/234 |
| 2,783,759 | 3/1957 | Hill | 128/133 |
| 3,271,832 | 9/1966 | Yankers | 2/234 |
| 3,276,086 | 10/1966 | Reese | 2/234 |
| 4,298,299 | 11/1981 | Quarles | 24/573 |
| 4,514,915 | 5/1985 | Galetta | 36/117 |

FOREIGN PATENT DOCUMENTS 917644 2/1963 United Kingdom .

*Primary Examiner*—Louis K. Rimrodt
*Assistant Examiner*—Joseph S. Machuga
*Attorney, Agent, or Firm*—Varnum, Riddering, Schmidt & Howlett

[57] ABSTRACT

A pants closure adapted for use on a pair of pants (12) comprising a first plate (14) mounted to the underlapping flap (39) of pants (12) and having a retaining clasp (16) extending outwardly therefrom; a slide handle (52) attached to slide elements (46, 48) and with a first hole (54) which fits over the retaining clasp (16); and a second plate (20) mounted to the overlapping flap (36) of pants (12) and having a second hole (22) which fits over the retaining clasp (16). When the forgoing elements are assembled, the slide handle (52) is sandwiched between first plate (14) and second plate (20) while in registry with retaining clasp (16). A padlock (24) is mounted on retaining clasp (16) when retaining clasp (16) extends through second plate (20) with slide handle (52) secured onto retaining clasp (16) between first plate (14) and second plate (20), thereby closing the vertical opening (66), formed when a left flap (36) and a right flap (38) of pants (12) are apart, and preventing locking slide (50) from moving down and side elements (46,48) from opening while pants (12) are being worn.

15 Claims, 4 Drawing Figures

PANTS CLOSURE

FIELD OF THE INVENTION

This invention relates to pants closures used for securing slide fastener elements incorporated into the fly opening of trousers or similar articles of apparel to prevent opening of the slide fastener elements while the trousers are being worn.

DESCRIPTION OF THE PRIOR ART

All too often the slide fastener elements, incorporated into the fly opening of trousers or similar articles of apparel, gradually open while the trousers are being worn, resulting in an embarrassing situation. This unfortunate event may occur (1) if the fly opening was improperly closed, or (2) subsequent to the inadvertent unlatching of the pants closure by the wearer while the trousers are being worn.

In the past, many pants closures have been suggested to prevent the possibility of slide fastener elements from opening. However, these devices have been unsuccessful in accomplishing this task. As examples, the U.S. patents to Yankers U.S. Pat. No. 3,271,832, Miller U.S. Pat. No. 2,675,599, Glass U.S. Pat. No. 2,688,138 and Perry U.S. Pat. No. 2,591,193, all disclose pants closures wherein the zipper handle of the zipper is connected to trouser-closure elements when the slide fastener elements are in the closed position; thereby attempting to secure together the front flaps of the trousers and seal the vertical opening there between. However, none of the above-stated references disclose pants closures that would absolutely guarantee that the slide fastener elements of the fly opening would remain securely closed and locked when the trousers are in use. For example, in Perry, it is possible, when the trousers are being worn, that hook portion 92 of tab 88 would disengage eye 94 thereby allowing glide 89 to move in the downward direction resulting in separation of the slide fastener elements. There is no element in Perry that locks the pants closure elements in the closed position. Similarly, Yankers does not disclose a component that would guarantee against hook 37 and pull tab 35 from disengaging loop 23, through inadvertent movement by the trouser wearer, eventually resulting in the opening of the trouser fly.

Therefore, it is important to insure that the slide fastener elements, incorporated into the fly opening thereof, remain in the closed position when the trousers are being worn. Until the applicant's invention, the state of the art could not provide the trouser wearer absolute assurance that the slide fastener elements would remain closed.

SUMMARY OF THE INVENTION

The purpose of the invention is to prevent slide fastener elements of trousers in the closed position from opening when the trousers are being worn.

According to the preferred embodiment of the invention, a pants closure positioned on the front of a man's or woman's pants comprises a first plate mounted onto the underlapping flap of the pants and having a U-shaped retaining clasp extending outwardly therefrom; an elongated slide handle connected to the slide elements of the fly opening by a locking slide and with a first hole adapted to fit over the U-shaped retaining clasp; and a second plate mounted to the overlapping flap of the pants and having a second hole adapted to fitting over the retaining clasp. When the foregoing elements are assembled, the slide handle is sandwiched between the first and second plate while in registry with the U-shaped retaining clasp, and the side elements are partially secured in the closed position.

In order to fully secure and lock the slide elements in the closed position, thereby securely closing the fly opening formed when the overlapping and underlapping flaps of the pants are apart, a padlock is secured onto the U-shaped retaining clasp when, as stated above, the retaining clasp extends through the second plate with the slide handle secured onto the retaining clasp between the first and second plates.

In another embodiment of the invention, a rod having a third hole at its free end and extending perpendicular to and through the axial length of the rod and cotter pin slidably connectable to the third hole can be used in lieu of the U-shaped retaining clasp and the padlock, respectively. In this embodiment, when the slide handle is sandwiched between the first and second plates and is in registry with the rod and the cotter pin is secured to the rod through the third hole, the slide elements are securely locked in the closed position as in the preferred embodiment.

Since it is possible for this invention to be sold in kit form, rather than sold incorporated onto the front of trousers, applicant's invention can include any combination of the above-stated components of the pants closure adapted to fitting on the front of a man's or woman's pants.

Preferably, the first plate, retaining clasp (or rod), slide handle, locking slide, second plate and padlock (or cotter pin) could be made out of brass or bronze plated steel. However, other types of materials such as plastic, can also be used.

BRIEF DESCRIPTION OF DRAWINGS

The invention will now be described with reference to the accompanying drawings in which.

DESCRIPTION OF THE PREFERRED EMBODIMENTS

Figure 1:
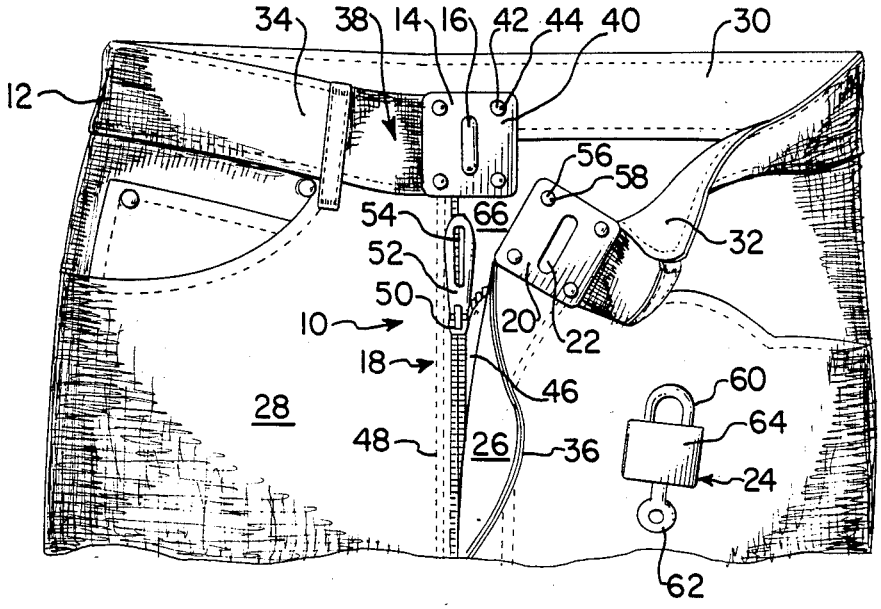
FIG. 1 is a front fragmentary view of a pants closure according to the invention positioned on the front of a man's or woman's pants in the unlatched position.

Referring now to the drawings in detail, there is shown a novel pants closure 10 positioned on the front of a man's or woman's pants 12. The pants closure is composed of a first plate 14 with a retaining clasp 16, a slide fastener unit 18, second plate 20 with a second hole 22 and a padlock 24. The pants include a front, left panel 26 and a front, right panel 28 bounded along their upper portions to a waistband 30 that has opposite ends 32 and 34. Panel 26 adjacent waistband panel 32 forms overlapping flap 36, and panel 28 adjacent waistband 34 forms underlapping flap 38.

First plate 14 is comprised of a retaining clasp 16 secured to the outer face 40 of first plate 14 by welding or otherwise, and four holes 42 through each of which fits a rivet 44 whereby first plate 14 is securely fastened to the upper-most portion of the flap 38. Alternatively, first plate 14 can be sewn onto flap 38 in which case holes 42 and rivets 44 are unnecessary.

Figure 2:
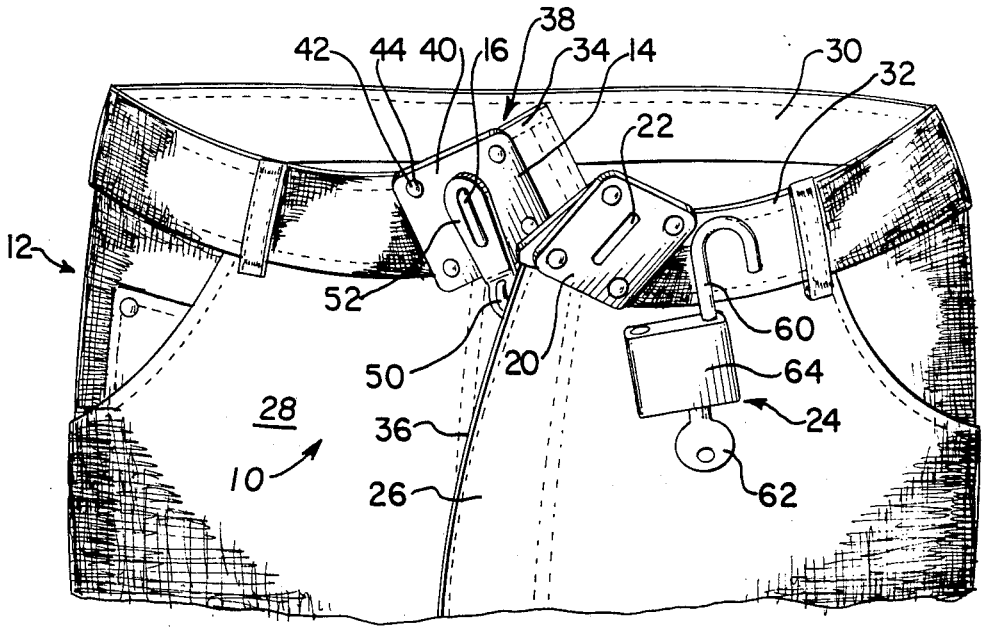
FIG. 2 is a front fragmentary view of the pants closure shown in FIG. 1 in partially latched condition.
Figure 3:
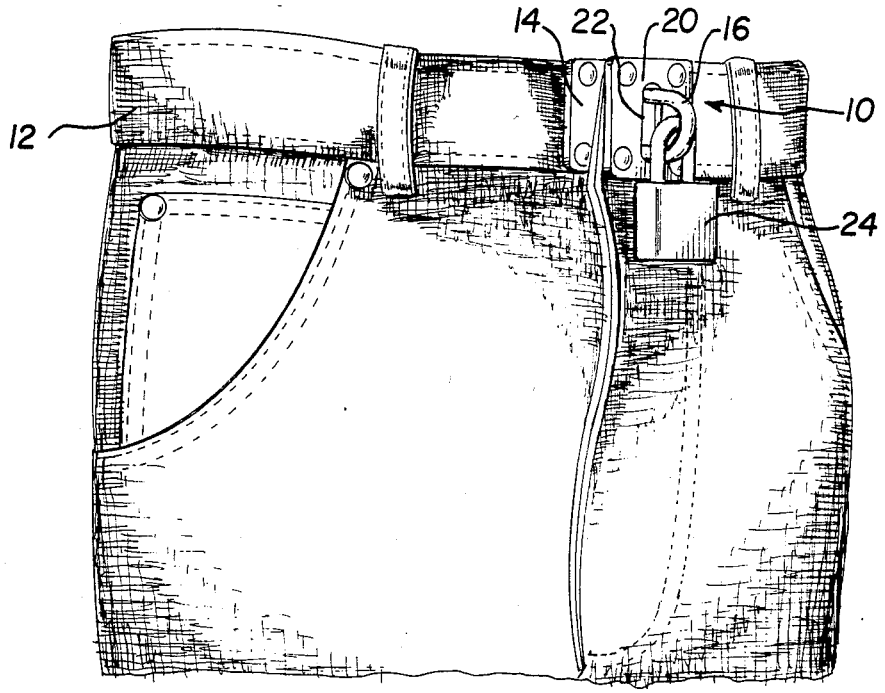
FIG. 3 is a front perspective view of the pants closure positioned on the front of a man's or woman's pants fully closed and locked.

Slide fastener unit 18 is comprised of a left slide element 46 sewn or otherwise secured to flap 36, a corresponding right slide element 48 sewn or otherwise secured to flap 38, and a locking slide 50 attached to a slide handle 52. Slide handle 52 is an elongated flat member with a first hole 54 at one end, and is hingedly secured at the other end in a conventional manner to locking slide 50 as shown in FIGS. 1 and 2. Locking slide 50 and slide handle 52 can act as a means joining the slide elements.

Second plate 20 is comprised of a second hole 22 and four holes 56, through each of which fits a rivet 59 whereby second plate 20 is securely fastened to the uppermost portions of flap 36. Alternatively, second plate 20 can be sewn onto flap 36 in which case holes 56 and rivets 58 are unnecessary.

Padlock 24 is of the ordinary variety and consists of a lock body 64 and U-shaped swivel locking arm 60 which can be unlocked by key 62, as shown in FIGS. 1 and 2, or by combination.

In operation, as illustrated in FIGS. 1 and 2, to secure the pants in a closed position, locking slide 50 is pulled up completely by pulling in an upward direction slide handle 52 attached thereto, thus bringing together left slide element 46 and right side element 48 and closing vertical opening 66. Slide handle 52 is then fitted over retaining clasp 16 such that the slide handle is laid flat against the outer face 40 of first plate 14 and the U-shaped clasp protrudes through first hole 54. Subsequently, second plate 20 is fitted over the retaining clasp 16 such that it is laid flat against slide handle 52 and sandwiches the slide handle between first plate 14 and itself. Padlock 24 is then slidably secured to U-shaped clasp 16 by sliding U-shaped swivel locking arm 60 through the U-shaped clasp and closing and locking the U-shaped swivel locking arm into lock body 64 in the conventional manner.

In this process, the vertical opening 66, formed when the left flap 36 and right flap 38 of pants 12 are apart, can be securely closed as shown in FIG. 1 without the possibility of the flaps opening and/or the locking slide 50 moving down while in use, as was the case with prior art pants closures; thereby avoiding an embarrassing situation.

The pants closure, in the fully secured position, may then be opened by following the steps taken to close the same in the reverse order, except that the first step would be that of unlocking padlock 24 with key 62 rather than locking U-shaped swivel locking arm 60 to lock body 64 in a conventional manner.

The first plate 14 with retaining clasp 16, slide fastener unit 18 and second plate 20 can be made from any suitable structural material, including plastics and metals, but is preferably made from a metal alloy such as brass or steel.

Since it is possible for this novel invention to be sold in kit form, rather than sold on pants by a pants manufacturer, the invention can include a combination of any of the following: a first plate 14 with a retaining clasp 16, a means for connecting the first plate to the underlapping flap, a slide handle 52 with first hole 54, a locking slide 50, a second plate 20 having a second hole 22, a means for connecting the second plate to the overlapping flap and a padlock 24.

Figure 4:
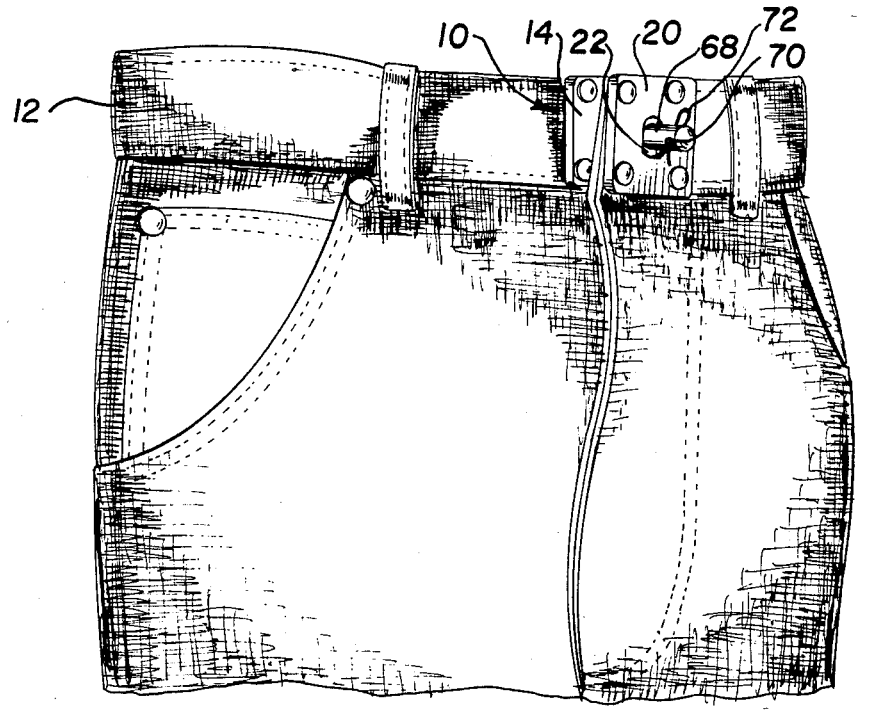
FIG. 4 is a view similar to FIG. 3 showing a variational form of the invention.

In lieu of the padlock 24, as a means of securing slide handle 52 between first plate 14 and second plate 20 on retaining clasp 16, other securing means can be used in the invention. For example, a ring, such as a key ring, that slidably joins the retaining clasp could be substituted for the padlock. Alternatively, a retaining clasp, different from and replacing retaining clasp 16, that hingedly bends to the left or right securely fastening said slide handle and second plate over said first plate can be utilized. Further, as illustrated in FIG. 4, the pants closure 10 can comprise a rod 68 having a third hole 70 at its free end extending perpendicular to and through the axial length of rod 68 in lieu of retaining clasp 16. In this embodiment, a cotter pin 72 or other suitable retaining means can be secured to third hole 70 in rod 68.

While the invention will be described in connection with a preferred embodiment, it will be understood that I do not intend to limit the invention to that embodiment. To the contrary, I intend to cover all alternatives, modifications and equivalents as may be included within the spirit and scope of the invention as defined by the appended claims.

I claim:

1. In a pair of pants, the combination of a pair of flaps, one of the flaps overlapping the other flap to form an overlapping flap and an underlapping flap, a pair of slide fastener elements, one secured to one flap and the other secured to the other flap, a means for joining the slide fastener elements, and a pants closure securely fastened to the pants for fastening the flaps together, wherein the pants closure comprises:

a first plate;

a retaining clasp securely fastened to and projecting from the first plate;

a means securely fastening the first plate to the underlapping flap;

a means joining the slide fastener elements and having a first hole adapted to receive the retaining clasp therethrough;

a second plate having a second hole adapted to receive the retaining clasp therethrough;

a means securely fastening the second plate to the overlapping flap so that the second plate overlaps the first plate with the retaining clasp in registry with the second hole when the flaps are closed;

a locking means engaging the retaining clasp for securing the first and second plates in an overlapping position;

whereby the pants are secured in a closed position with the slide fastener element joining means securely locked in a sandwiched position between the overlapping first and second plates.

2. A pants closure according to claim 1 wherein said first plate, said retainer clasp, said means joining said slide fastener elements, said second plate and said locking means are made of bronze-plated steel.

3. A pants closure according to claim 2 wherein said slide fastener element joining means comprises a locking slide and an elongated flat slide handle having a first hole at one end adapted to receive said retaining clasp and being hingedly secured at another end to the locking slide connected to said slide fastener elements.

4. A pants closure according to claim 3 wherein said means securely fastening said first and second plates to said underlapping and overlapping flaps, respectively, comprises a plurality of holes and rivets fitting through said holes.

5. A pants closure according to claim 3 wherein said retaining clasp comprises a U-shaped member securely fastened to and projecting from said first plate.

6. A pants closure according to claim 5 wherein said locking means comprises a padlock having a lock body, a swivel locking arm and a key, whereby said swivel locking arm is slidably secured to said U-shaped retaining clasp by sliding said swivel locking arm through said U-shaped retaining clasp and locking said swivel locking arm into said lock body.

7. A pants closure according to claim 4 wherein said retaining clasp comprises a rod securely fastened to and projecting from said first plate and having a hole at its free end running perpendicular to and through the axial length of the rod.

8. A pants closure according to claim 7 wherein said locking means engaging said retainer clasp for securing the first and second plates in an overlapping position comprises a cotter pin slidably joining said retaining clasp.

9. A pants closure adapted for mounting to a pair of pants having underlapping and overlapping flaps, a pair of slide fastener elements, one secured to one flap and the other secured to the other flap, and a means joining the slide fastener elements, the pants closure comprising:

a first plate connectable to the underlapping flap;

a retainer clasp securely fastened to and projecting from the first plate;

a means for securely connecting the first plate to the underlapping flap;

a means for joining the slide fastener elements and having a first hole adapted for receiving the retaining clasp therethrough;

a second plate connectable to the underlapping flap and having a second hole adapted to receive the retaining clasp therethrough;

a means for securely connecting the second plate to the overlapping flap so that the second plate overlaps the first plate with the retaining clasp in registry with the second hole when the flaps are closed;

a locking means engaging the retainer clasp for securely locking in a sandwiched position the slide fastener element joining means between the overlapping first and second, plates.

10. A pants closure according to claim 9 wherein said slide fastener element joining means comprises an elongated flat slide handle having a first hole at one end adapted to receive said retaining clasp and connectable at another end to a locking slide connected to said slide fastener elements.

11. A pants closure according to claim 10 wherein said means for connecting said first and second plates to said underlapping and overlapping flaps, respectively, comprises a plurality of holes and rivets adapted to fit through said holes.

12. A pants closure according to claim 11 wherein said retaining clasp comprises a rod securely fastened to and projecting from said first plate and having a hole at its free end running perpendicular to and through the axial length of the rod.

13. A pants closure according to claim 12 wherein said locking means engaging said retainer clasp for securing the first and second plates in an overlapping position comprises a cotter pin adapted for slidably joining said retaining clasp.

14. A pants closure according to claim 10 wherein said retaining clasp comprises a U-shaped member securely fastened to and projecting from said first plate.

15. A pants closure according to claim 14 wherein said locking means comprises a padlock.

* * * * *